United States Patent [19]

Itoh et al.

[11] Patent Number: 4,473,741

[45] Date of Patent: Sep. 25, 1984

[54] COUNTER

[75] Inventors: Nobuyasu Itoh; Tadashi Fujino, both of Urawa; Tsutomu Kashiwagi, Tokyo, all of Japan

[73] Assignee: Dai-Ichi Seiko Co., Ltd., Kawaguchi, Japan

[21] Appl. No.: 416,374

[22] Filed: Sep. 9, 1982

[30] Foreign Application Priority Data

Sep. 11, 1981 [JP] Japan ..... 56-143405
Oct. 27, 1981 [JP] Japan ..... 56-171752

[51] Int. Cl.[3] ..... G06C 5/02; G06C 15/42
[52] U.S. Cl. ..... 235/1 D; 235/144 R
[58] Field of Search ..... 235/1 R, 1 D, 95 R, 235/96, 139 R, 144 R, 144 HC

[56] References Cited

U.S. PATENT DOCUMENTS 3,302,876 2/1967 Fox ..... 235/139 R X
4,221,327 9/1980 Sato et al. ..... 235/144 HC
4,293,765 10/1981 Kashiwagi ..... 235/144 R
4,354,097 10/1982 Menager ..... 235/96

*Primary Examiner*—Benjamin R. Fuller
*Attorney, Agent, or Firm*—Cushman, Darby & Cushman

[57] ABSTRACT

A counter consists of, to simplify the control of component parts and to improve the productivity, a first frame unit comprising a plurality of digit wheels, a driving gear for a digit wheel of a lower most order, an order shifting-up means and a zero-resetting means, a second frame unit being capable to be snap fitted on the first frame unit and comprising a driving means to be coupled with the driving gear when attached to the first frame unit, and a cover frame unit being capable to be snap fitted on the first frame unit and to show only one line of the laterally lined digits when attached to cover the first frame unit. The second frame unit may be the base plate of the devices on which the counter will be used. The first frame unit may comprise only a plurality of digit wheels, a driving gear for a digit wheel of a lower most order and a zero-resetting button, and the second frame unit may comprise an order shifting-up means and a zero-resetting means.

10 Claims, 10 Drawing Figures

COUNTER

BACKGROUND OF THE INVENTION (a) Field of the Invention:

The present invention relates to a zero-resetting counter of the type wherein a plurality of digit wheels is used.

(b) Description of the prior art:

A conventional counter of this kind was constituted by assembling all such parts and mechanisms as a plurality of digit wheels, an order shifting-up means, a zero-resetting means and a driving means comprising gears to transmit the rotating movement to digit wheels and a pulley into a single body frame. Therefore, even when the dimensions of the device to which a counter will be attached are predetermined and the mode of the device will be varied, no variation will be made on the digit wheels, order shifting-up means, zero-resetting means and driving means to be connected with the digit wheels and some variations will be demanded only with the attaching position of the driving means against the body frame, the size of pulley and the attachment of the body frame. Nevertheless, in practice, it was necessary to prepare beforehand many sorts of parts and to properly combine in accordance with the presented specifications and assemble the parts one by one. Consequently, the control of the parts in the manufacturing section was very troublesome and the productivity was very low.

SUMMARY OF THE INVENTION

The main object of the present invention is, in view of the above-mentioned circumstances, to provide a zero-resetting counter simple in the control of component parts and easy to produce.

According to the present invention, this object is achieved by providing a first frame unit assembled therein at least a plurality of digit wheels and a gear capable of rotating the digit wheel of the lowermost order, a second frame unit detachably coupled to the first frame unit and assembled therein at least a driving gear to be meshed with the gear when coupled to the first frame, and an order shifting-up means and a zero-resetting means capable of being assembled alternatively in the first and second frame units.

According to the preferred formation of the present invention, the first frame unit and the second frame unit are coupled to each other with snap fit and the second frame unit is covered by a cover unit which is provided with a window adapted to see only a line of the laterally lined digits and is to be coupled to the second frame unit with snap fit. This makes not only easy to produce a compact sized counter but also makes possible to produce in automation and to reduce remarkably the cost of production. Moreover, if the mechanism to decide the basic functions as a counter is set in the first frame, it is possible to provide many kind of counters with a uniform quality only by exchanging the cover frame units and/or the second frame units.

According to another formation of the present invention, the second frame unit is formed with the base plate or the frame of the device on which a counter will be used. This results in that the driving element such as a pulley which was not able to be separated in a conventional counter is able to be directly attached on the base plate or the frame of said device and consequently that the space of the device is able to be used efficiently.

This and other objects of the present invention will become more apparent during the course of the following detailed description and appended claims.

DESCRIPTION OF THE PREFERRED EMBODIMENT

Figure 1:
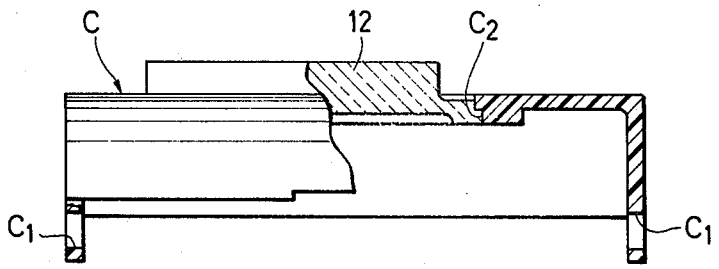
FIG. 1 is a partially borken front view showing an embodiment of the cover unit.

Referring now to the FIGS. 1 through 6, reference symbol A represents a first frame, B represents a second frame to be coupled to the first frame A and C represents a cover frame to be coupled to the first frame A to cover the first frame A according to the necessity. They are all made of a material, for example a synthetic resins, which has a certain flexibility. The first frame A is rectangular and has two pairs of circular projections $A_1$, $A_1$ and $A_2$, $A_2$, a pair of rail-like prominences $A_3$, $A_3$ and pierced holes $A_4$ and $A_5$ on the side walls of opposite shorter sides. The conventional digit wheels 1, 2 and 3 comprising gears 2*a* and 3*a*, heart-shaped cams 1*b*, 2*b* and 3*b* for zero-resetting and toothed part unillustrated for the order shifting-up are rotatably mounted on an unillustrated support shaft inserted in the pierced hole $A_4$ of the first frame A. A worm gear 4 rotatably mounted on said support shaft, has a flange 4*a* with the same outer diameter as the digit wheel 1 and arranged so as to race against the digit wheel 1 only when the digit wheel 1 is controlled with the power surpassing a pretermined value by the unillustrated friction-clutch means interposed between said flange 4*a* and the adjacent side of the digit wheel 1 (see, for example, U.S. Pat. No. 4,293,765). Order shifting-up pinions 5 and 6 are rotatably mounted on the unillustrated support shaft inserted in the pierced hole $A_5$ of the first frame A. The pinion 5 is able to be meshed with the order shifting-up toothed part of the digit wheel 1 and is meshed constantly with the gear 2*a* of the digit wheel 2, and the pinion 6 is able to be meshed with the order shifting-up toothed part of the digit wheel 2 and is meshed constantly with the gear 3*a* of the digit wheel 3. The above-mentioned order shifting-up toothed parts, gears 2*a* and 3*a* and order shifting-up pinions 5 and 6 form the order shifting-up means. The further detailed description of the order shifting-up means will be omitted here since the order shifting-up means is well-known. A zero-resetting member 7 rotatably mounted on the support shaft for order shifting-up pinions 5 and 6 comprises an arm 7*a*, a zero-resetting nail 7*b* engageable with the heart-shaped cam 1*b* of the digit wheel 1, a zero-resetting nail 7*c* engageable with the heart-shaped cam 2*b* of the digit wheel 2 and a zero-resetting nail 7*d* engageable with the heart-shaped cam 3*b* of the digit wheel 3. A spring 8 wound around a sleeve of the zero-resetting member 7 biases the zero-resetting member 7 so as to rotate in a direction where the zero-resetting nails 7*b*, 7*c* and 7*d* will be separeted from the each heart-shaped cam 1*b*, 2*b* and 3*b*. A zero-resetting bar 9 slidably mounted on the one side of the first frame A comprises a projection 9*a* engaged with the arm 7*a* of the zero-resetting member 7 and a push 9*b*. The zero-resetting member 7, spring 8 and zero-resetting bar 9 form a zero-resetting means. Nextly, the second frame B formed so as to be aligned with the first frame A comprises a standing wall having a pair of pierced holes $B_1$, $B_1$ in which the circular projections $A_2$, $A_2$ formed on the side of the first frame A will snap fit when the second frame B is coupled with the first frame A, a pair of attachment foot $B_2$, $B_2$ and a rotatably mounted worm 10 which functions as a driving gear to be meshed with the worm gear 4 when the second frame B is coupled with the first frame A. A pulley 11 is secured to a rotary shaft 10*a* of the worm 10. Further, the cover frame C formed so as to be aligned with the first frame A comprises a pierced hole $C_1$ on the side in which the circular projection $A_1$ formed on the side of the first frame A will snap fit when the cover frame C is coupled with the first frame A and a lens 12 adhered to a window $C_2$ formed on the top.

In the counter according to the present invention which is formed as mentioned above, the first frame A, second frame B and cover frame C can be prepared separately. If the digit wheels, worm gear, order shifting-up means and zero-resetting means are pre-assembled on the first frame A, the worm 10 and pulley 11 on the second frame B, and the lens 12 on the cover frame C respectively, it is possible to obtain a zero-resetting counter of the conventional type very easily by coupling the first frame A and second frame B, and further, by coupling the cover frame C on the above counter, it is possible to obtain a counter with a windowed cover on the top in which only a line of laterally lined digits is shown as enlarged. In this case, it is preferable that the zero-resetting member 7 is so arranged that it is interchangeable against the first frame A. And the coupling of the first frame A with the second frame B and/or the cover frame C will be made in snap fit. That is, because these frames have a certain flexibility as mentioned above and the circular projections $A_1$ and $A_2$ are tapered as clearly illustrated in FIG. 2, the coupling between the first frame A and second frame B will be done by bringing both of them near from the positions illustrated in FIGS. 2 and 3, aligning them and pressing them strongly so that the standing wall of the second frame B will once bend outward by the tapered part of the circular projection $A_2$ and the bended standing wall will return to the normal state instantaneously after the pierced hole $B_1$ and the circular projection $A_2$ are coupled. The coupling of the first frame A and cover frame C will be done in a same way.

The fuction of the assembled counter is same as that of the conventional counter. That is to say, when the pulley 11 connected with the power generating member of the device is rotated, the digit wheel 1 of the lower most order will be rotated through the worm 10 and worm gear 4. Then, when the digit wheel 1 completes one revolution and reaches at the last step, the digit wheel 2 to denote the digits of the second order from the last will be rotated by the angle corresponding to one digit through the order shifting-up pinion 5. And then, when the digit wheel 2 completes one revolution, the digit wheel 3 to denote the digits of the third order from the last will be rotated only by one digit in the same way through the order shifting-up pinion 6 to denote the counted number. By pushing down the zero-resetting bar 9, the zero-resetting member 7 will be rotated around the support shaft against the spring 8 and all of the digit wheels, 1, 2 and 3 will be rotated at once to the zero position through the co-operation of the zero-resetting nails 7*b*, 7*c* and 7*d* with the heart-shaped cams 1*b*, 2*b* and 3*b*. When the pressure on the zero-resetting bar 9 is released, the relevant elements will return to the illustrated positions through the resilience of the spring 8. Since these functions are well known, more detailed description will be omitted.

Figure 2:
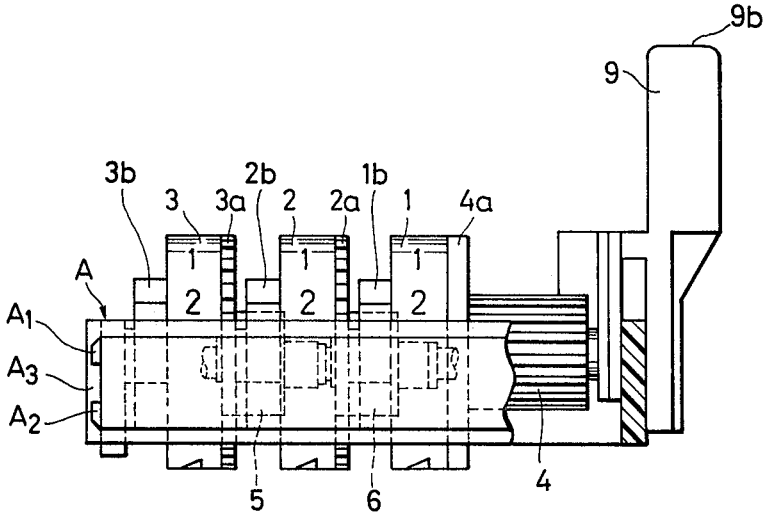
FIG. 2 is a partially broken front view showing an embodiment of the first frame unit.
Figure 3:
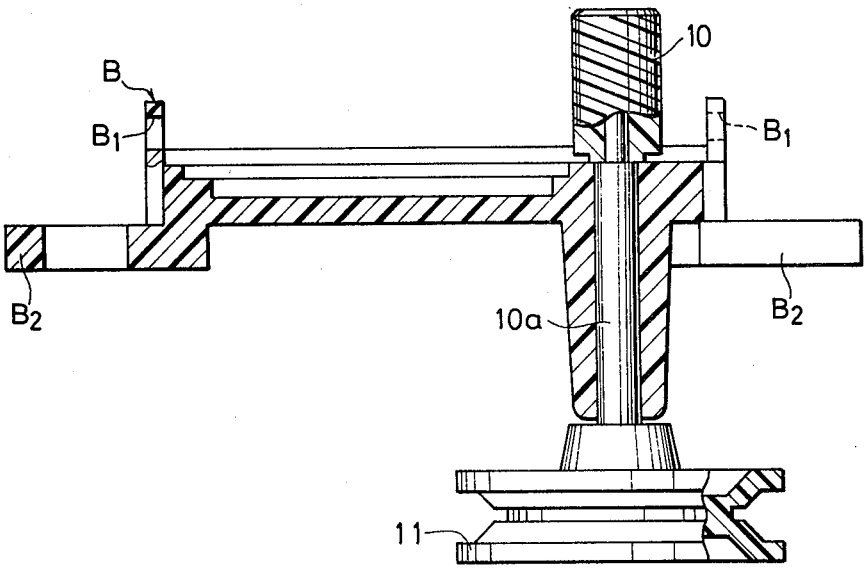
FIG. 3 is a sectional view showing an embodiment of the second frame unit.
Figure 7:
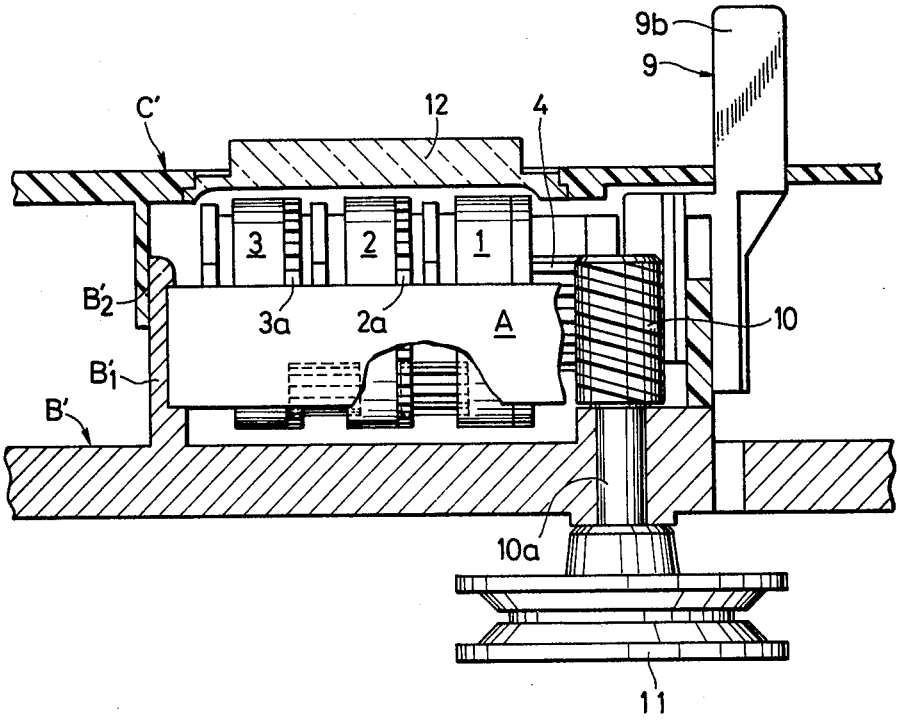
FIG. 7 is a sectional view showing another embodiment of the counter according to the present invention.

FIG. 7 is an embodiment in which the second frame B illustrated in FIG. 3 corresponds to the base plate or the frame of the device on which the present counter is to be mounted. That is, because the standing wall $B'_1$, to support the first frame A, and the worm 10 and pulley 11 attached through the rotary shaft 10*a* are provided on the base plate or the frame B' the counter will be usable immediately only by coupling with snap fit the first frame A assembled as mentioned before to the base plate or the frame B' using the hook $B'_2$. C' is a cover with the window for the above-mentioned device on which the lens 12 is attached. In this embodiment, because the second frame is unnecessary and only the assembly illustrated in FIG. 2 is necessary to be fabricated, it is very convenient for the mass production.

Figure 8:
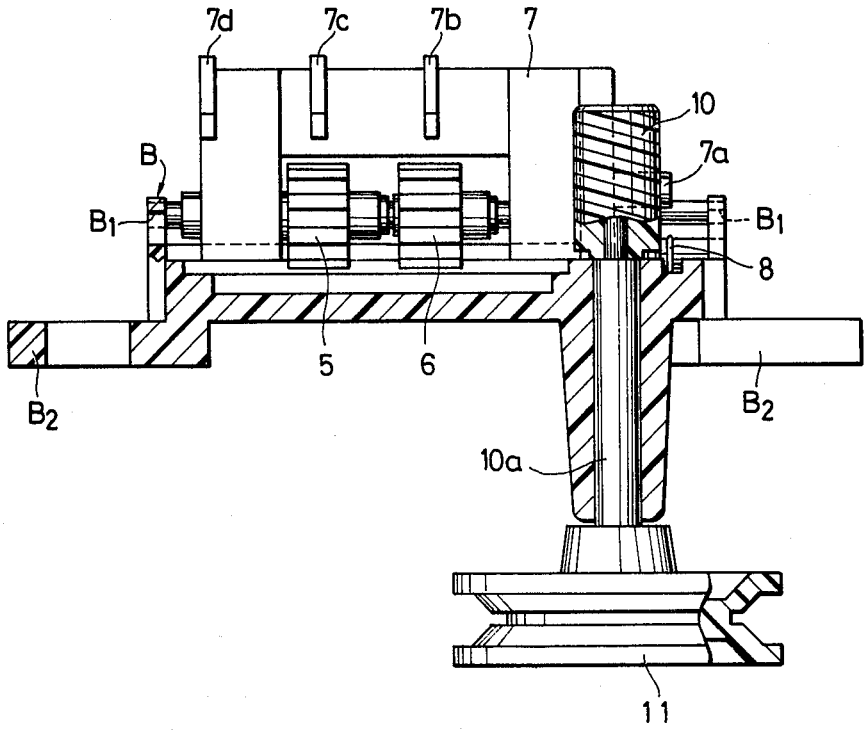
FIG. 8 is a sectional view showing another embodiment of the second frame unit.

FIG. 8 shows an embodiment in which the second frame B is pre-assembled with a part of the order shifting-up means, that is, the order shifting-up pinions 5 and 6 and the support shaft to support them rotatably and a part of the zero-resetting means, that is, the zero-resetting member 7 and the spring 8. In this case, the zero-resetting member 7 is attached interchangeably against the second frame B.

Figure 4:
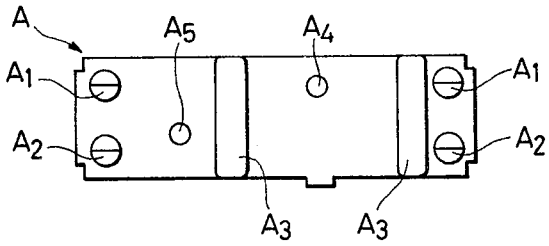
FIG. 4 is a side view of the first frame unit illustrated in FIG. 2.
Figure 5:
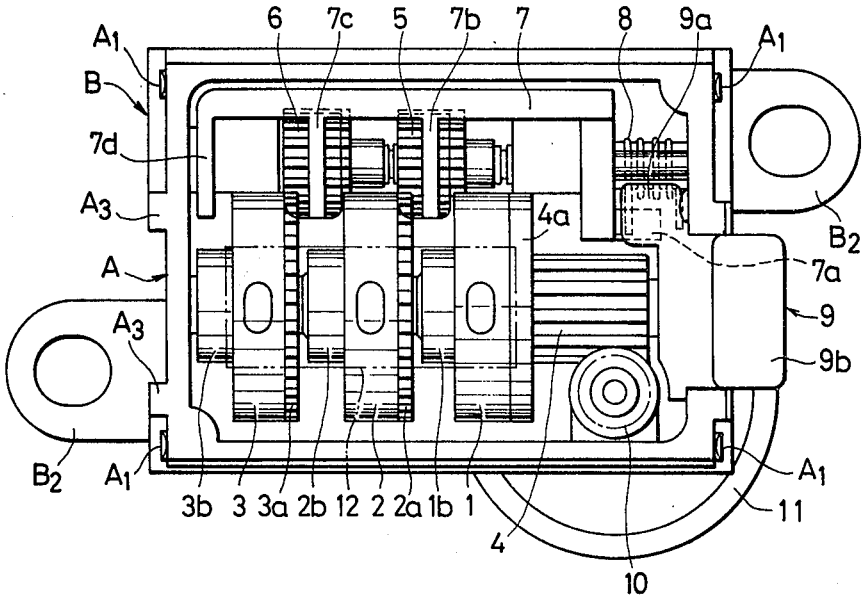
FIG. 5 is a plane view of FIG. 2.
Figure 6:
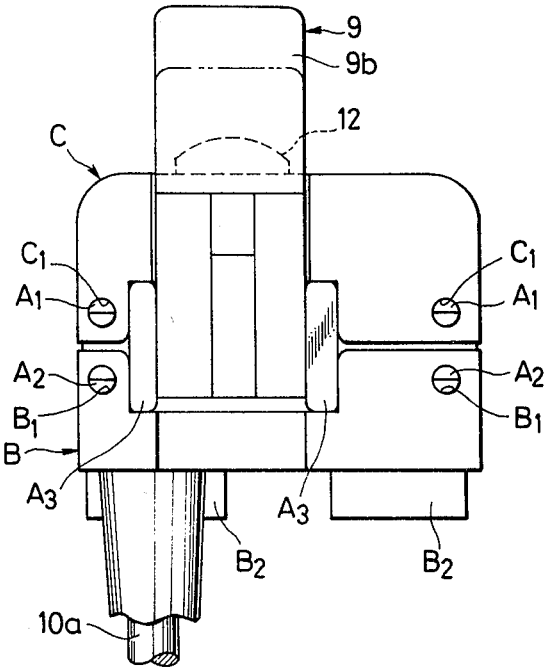
FIG. 6 is a side view of an embodiment of the counter according to the present invention.
Figure 9:
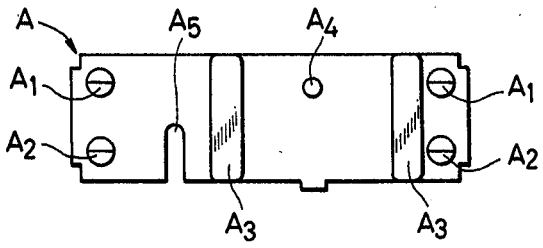
FIG. 9 is a side view showing another embodiment of the first frame unit.

FIG. 9 shows another embodiment different from the embodiment shown in FIG. 4 in respect that the pierced hole $A_5$ to be arranged on the side of the first frame A is formed as the U shaped groove opened at the undermost edge of the side.

Figure 10:
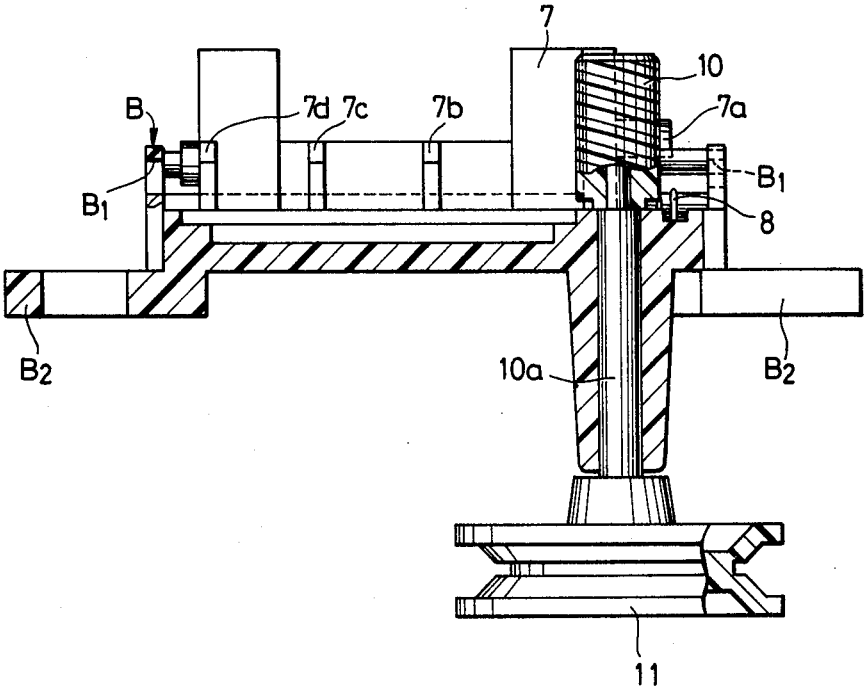
FIG. 10 is a sectional view showing still another embodiment of the second frame unit.

FIG. 10 shows a still another embodiment in which the second frame B is pre-assembled with a part of the zero-resetting means, that is, the zero-resetting member 7 and the spring 8.

The above is the description of the embodiments that have some differences between each other, and yet they do not limit the scope of the present invention. That is, it is possible to adopt the well-known conventional constitutions for the constitution and form of the frames A, B and C, the digit wheels, power transmitting means, order shifting-up means and zero-resetting means to be assembled in the first frame and the driving means and so on to be assembled in the second frame. Further, the zero-resetting means may be assembled in the second frame B, because the attaching position of the zero-resetting bar 9 is possibly changed in many ways, for example, on the right-hand side, the left-hand side or the middle of the first frame, with relation to the device on which the counter will be mounted. Furthermore, if the cover frame, the first frame and the second frame are colored distinctively, it is convenient for the control of manufacturing because of the possibility to identify the counters of different kinds with the combination of colors.

We claim:

1. A counter comprising:

a first frame unit having at least a pair of first projections on its side wall and assembled therein at least a plurality of digit wheels and a first gear capable of rotating the digit wheel of the lowermost order to count, a second frame unit having on its side wall at least a pair of pierced holes into which said first projections can fit respectively and assembled therein at least a driving gear to be meshed with said first gear when said second frame unit is coupled to said first frame unit, an order shifting-up means and a zero-resetting means capable of being assembled alternatively in said first and second frame units, said first projections being tapered and said second frame unit being made of a flexible material so that said first projections snap fit respectively into said pierced holes of said second frame unit when said second frame unit is to be coupled to said first frame unit.

2. A counter according to claim 1 wherein said first frame unit has at least a pair of second projections on its side wall, said counter further comprising a cover unit having on its side wall at least a pair of pierced holes into which said second projections can fit respectively and having therein a window adapted to see a counted number indicated by said plurality of digit wheels, and said second projections are tapered and said cover unit is made of a flexible material so that said second projections snap fit respectively into said pierced holes of said cover unit when said cover unit is to be coupled to said first frame unit.

3. A counter according to claim 2 wherein an enlarging lens is fitted to said window.

4. A counter according to claim 2 or 3 wherein said cover unit is a cover of a device to which said counter is attached.

5. A counter according to claim 1 or 2 wherein a pulley is secured coaxially to said driving gear.

6. A counter according to claim 1 or 2 wherein said first frame unit, second frame unit and cover unit are colored with color different from each other.

7. A counter according to claim 1 or 2 wherein said second frame unit is a base plate or frame of a device to which said counter is attached.

8. A counter according to claim 1 or 2 wherein said zero-resetting means comprises an exchangeable zero-resetting member.

9. A counter according to claim 1 wherein said first frame unit has at least a pair of pierced holes, said counter further comprises a cover unit having on its side wall at least a pair of projections capable of respectively fitting into said pierced holes of said first frame unit and having therein a window adapted to see a counted number indicated by said plurality of digit wheels, and said projections of said cover unit are tapered and said cover unit is made of a flexible material so that said projections of said cover unit snap fit respectively into said pierced holes of said first frame unit when said cover unit is to be coupled to said first frame.

10. A counter comprising:

a first frame unit having at least a pair of pierced holes on its side wall and having assembled therein at least a plurality of digit wheels and a first gear capable of rotating the digit wheel of the lowermost order to count;

a second frame unit having on its side wall at least a pair of projections capable of respectively fitting into said pierced holes of said first frame unit and having assembled therein at least a driving gear to be meshed with said first gear when said second frame unit is coupled to said first frame unit, an order shifting up means and a zero-resetting means capable of being assembled alternatively in said first and second frame units;

said projections being tapered and said second frame unit being made of a flexible material so that said projections snap fit respectively into said pierced holes when said second frame unit is to be coupled to said first frame unit.

* * * * *